US005316288A

United States Patent [19]

Fish et al.

[11] Patent Number: 5,316,288

[45] Date of Patent: May 31, 1994

[54] SHEET HANDLING APPARATUS AND METHOD FOR REGISTERING A SHEET USING A GATE DEVICE

[75] Inventors: David J. Fish, Webster; Jeffrey L. Andela, deceased, late of Sodus, by Christine R. Andela, executrix; Henry T. Chiavaroli, Honeoye Falls, all of N.Y.

[73] Assignee: Xerox Corporation, Stamford, Conn.

[21] Appl. No.: 153,942

[22] Filed: Nov. 16, 1993

Related U.S. Application Data

[63] Continuation of Ser. No. 330, Jan. 4, 1993, abandoned.

[51] Int. Cl.[5] ..... B65H 9/16

[52] U.S. Cl. ..... 271/250; 271/251

[58] Field of Search ..... 271/238, 240, 248, 250, 271/251, 253, 188

[56] References Cited

U.S. PATENT DOCUMENTS

| | | | |
|---|---|---|---|
| Re. 33,843 | 3/1992 | Naramore et al. | 271/251 |
| 3,945,636 | 3/1976 | Kockler et al. | 271/251 X |
| 4,482,147 | 11/1984 | Hibi et al. | 271/251 X |
| 4,984,778 | 1/1991 | Alexander et al. | 271/117 |
| 5,031,894 | 7/1991 | Bedzyk et al. | 271/248 |
| 5,080,345 | 1/1992 | Daniels | 271/248 X |
| 5,167,409 | 12/1992 | Higeta | 271/251 X |

FOREIGN PATENT DOCUMENTS

| | | | |
|---|---|---|---|
| 26741 | 2/1983 | Japan | 271/250 |
| 976607 | 12/1964 | United Kingdom | 271/251 |

*Primary Examiner*—Robert P. Olszewski
*Assistant Examiner*—Boris Milef

[57] ABSTRACT

A lateral sheet registering device for registering sheets transported along a path including a lateral registration edge positioned along the path. An apparatus is provided for driving sheets laterally and along the path so that a lateral edge of a sheet is registered along the lateral registration edge and so that sheets are transported along the path. The invention further includes a gate positioned in the path opposite said lateral registration edge for engaging an edge of a sheet to oppose rotation of such sheet in the path. The gate also is positioned to permit unimpeded transport of the lead edge of a sheet so that larger sheets are transportable within the path.

6 Claims, 3 Drawing Sheets

SHEET HANDLING APPARATUS AND METHOD FOR REGISTERING A SHEET USING A GATE DEVICE

This is a continuation of application Ser. No. 08/000,330, filed Jan. 4, 1993 now abandoned.

This invention relates generally to sheet handling and, more specifically, to a sheet handler apparatus employing a passive gate device for inhibiting skew of transported sheets.

U.S. Pat. No. 4,984,778 to Alexander, assigned to the Xerox Corporation and issued on Jan. 15, 1991, is hereby incorporated herein by reference thereto.

BACKGROUND OF THE INVENTION

Sheet handling devices of the type used in printing devices, such as electrophotographic printing machines, image input scanning devices, and the like, are well known. They are generally referred to in two categories being document handlers, which are used to transport sheets of material bearing images including, for example, Mylar, vellum, paper and the like, and copy sheet handlers, which transport sheets of similar material which, at least initially, generally are not image bearing. Both types of handlers are frequently employed with electrophotographic printing machines. That is, printers, duplicators and copiers commonly employ sheet handling devices to transport sheets to and from image imprinting stations (e.g., a transfer station in an electrographic printing machine) and image reproduction or imaging input station (e.g., an image input scanning station in an electrophotographic.printing machine). Image input devices which include scanners and the like, also employ sheet handling devices of the type to which this invention relates image bearing sheet to and from an imaging station.

In such devices employing such sheet handlers, inhibiting skew of the sheet transported is an important function to provide acceptable performance. For example, in electrophotographic printing machines employing copy sheet handlers, inhibiting skewing of transported sheets, and thus improving registration of sheets transported through the transfer station, is necessary to provide an output copy sheet having the image imparted thereto appear as desired (e.g., centered and aligned). Failure to provide registration in such cases, generally, results in unacceptable results (e.g., skewed images, images extending off a sheet and the like). Likewise, failure to control skewing and to register sheets bearing images, also known as documents, in document handlers results in the image produced therefrom to be similarly affected. Thus, in single automatic sheet feeding devices, such as document feeders known as semi-automatic document feeders, as well as automatic document feeders, and in sheet feeders known as by-pass sheet feeders, as well as automatic sheet feeders, skew control of the fed sheet is important in many applications, including particularly, those requiring registration of a fed sheet.

Many devices have been developed and techniques are used to register sheets. These devices include side or lateral registration edges in the loading areas of the sheets to be fed. In these cases, the user is required to load sheets for feeding proximate the edge. Active registering devices, such scuffer rollers, cross-rolls and the like have been used to achieve satisfactory results, in most cases. Users thereof who have properly inserted the sheet, achieve such results, provided that the lateral force is not to great to buckle the sheet and great enough to move the sheet. Therefore, many forms of apparatus and devices have been employed in registering and providing registration for sheets and/or documents transported in such sheet handling devices. Nevertheless, in certain cases lateral registration fails, particularly when heavy or special sheets are used. In some instances, this failure can result in the rotation or skewing of the sheet 90° from the desired registration. Besides resulting in misimaging of the sheet (i.e., an image is improperly formed from or on the sheet), these failures can also cause jams and other similar problems.

Applicants have noticed, for example, that in devices using cross-roll and scuffer-roll registering devices which are intended to laterally register a sheet and then have the sheet once registered slide along a lateral registration edge, heavier weight sheets such as label bearing sheets (e.g., AccoBrand labels), as well as vellum and the like, the sheets as fed, often laterally register on the so-called short edge despite the fact that they were to be laterally registered along the so-called long edge when inserted. In fact, the phenomenon appears to occur more frequently the closer the fed sheets are positioned to the lateral side registration edge when initially inserted (e.g., the suggested or preferred method for inserting sheets).

Applicants believe that this error results, generally, from the increased drive force generated on the heavier sheets by the registration devices. That is, for example, in cases of non-adjustable cross rollers, the normal force in the nip on sheets increases as the sheets become thicker. Further, the drag or frictional force engendered by the heavier weight sheets along the lateral registration edge also tend to be greater so that such sheets, instead of slipping in the nip in the lateral direction, tend to rotate or skew. Thus, there exists a need to overcome this type of problem.

The following patents and pending applications may be relevant to this invention:

U.S. Pat. No. 4,984,778
Patentee: Alexander et al.
Issued: Jan. 15, 1991
U.S. Pat. No. Re. 33,843
Patentee: Naramore et al.
Issued: May 17, 1988
U.S. Ser. No. 07/812,086
Applicant: Acquaviva et al.
Filed: Dec. 23, 1991

These patents and pending applications may be briefly summarized as follows:

U.S. Pat. No. 4,984,778, incorporated herein by reference discloses a electrophotographic printing machine having a by-pass feeding device with an idler roller to inhibit skewing of a sheet feed along a flat surface of the by-pass feeding device. The idler roller is mounted in the sheet path for rotational contact with a sheet being fed on the centerline of the sheet feeder surface. The idler roll has a high frictional contact surface which is mounted to provide a low drag force in the feeding direction and a high lateral drag force to inhibit skewing.

U.S. Pat. No. Re.33,843 discloses a set of cross-rollers which urge the lateral registration sheets along a registration edge as well as urge the transport of sheets in the process direction. The nip disclosed in this reference is formed by a drive roller and two opposed and separated idler rollers so that a corrugating nip is formed.

U.S. patent application Ser. No. 07/812,086 discloses a variable nip force cross-roll registration device. Specifically, a cross-roll device for laterally registering sheets and driving sheets in the process direction is constructed so that the normal or nip force on sheets in the nip is adjustable to compensate for various weights and characteristics of sheets to be registered by the cross-rolls.

In accordance with one aspect of the present invention, there is provided a lateral sheet registering apparatus for registering sheets transported along a path comprising a lateral registration edge positioned along the path. This aspect of the invention also includes means for driving sheets laterally and along the path so that a lateral edge of a sheet is registered along the lateral registration edge and so that sheets are transported along the path. The invention further includes a gate device positioned in the path opposite the lateral registration edge for engaging an edge of a sheet to oppose rotation of such sheet in the path. The invention can further include mounting the gate device to oppose rotation when engaged by the lateral edge opposite the lateral registration edge but to permit passage of the leading edge of a sheet which engages the gate.

Pursuant to another aspect of the present invention, a sheet handling device comprises a sheet path for receiving sheets and means for transporting sheets along the path in a process direction. The invention according to this aspect also comprises a sheet gate device for exerting an opposed lateral force on sheets transported by the transport means skewing from the process direction and a low force on sheets moving substantially linearly along said path so that sheets are transported substantially freely along the path. The invention can further comprise a second passive sheet gate device position on a side of said path opposed to said first device so that skewing of transported sheets in both rotational (clockwise and counterclockwise) directions is inhibited. This aspect can include positioning the sheet transport means between the opposed first and second gate devices.

Pursuant to still another aspect of this invention, there is provided a method for registering sheets comprising the steps of driving sheets along a path, directing sheets in a lateral direction of a registration edge, providing a registration guide opposed to the registration edge to skewing of the sheet in the path.

In accordance with yet a further aspect of this invention an apparatus for feeding sheets over a surface is provided, which comprises a means for feeding sheets over the surface in a process direction, and a gate device positioned to inhibit skewing of a sheet being feed along the surface. The apparatus of this aspect of the invention can further include a registration edge extending along the surface in the process direction, and means for laterally registering sheets fed by the feeding means along the registration edge.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims. For a general understanding of the features of the present invention, references should be made to the drawings. In the drawings, like numerals have been used to identify identical elements.

BRIEF DESCRIPTION OF THE DRAWING

Other aspects of the present invention will become apparent as the following description proceeds and upon reference to the drawings, in which.

DETAILED DESCRIPTION

Figure 3:
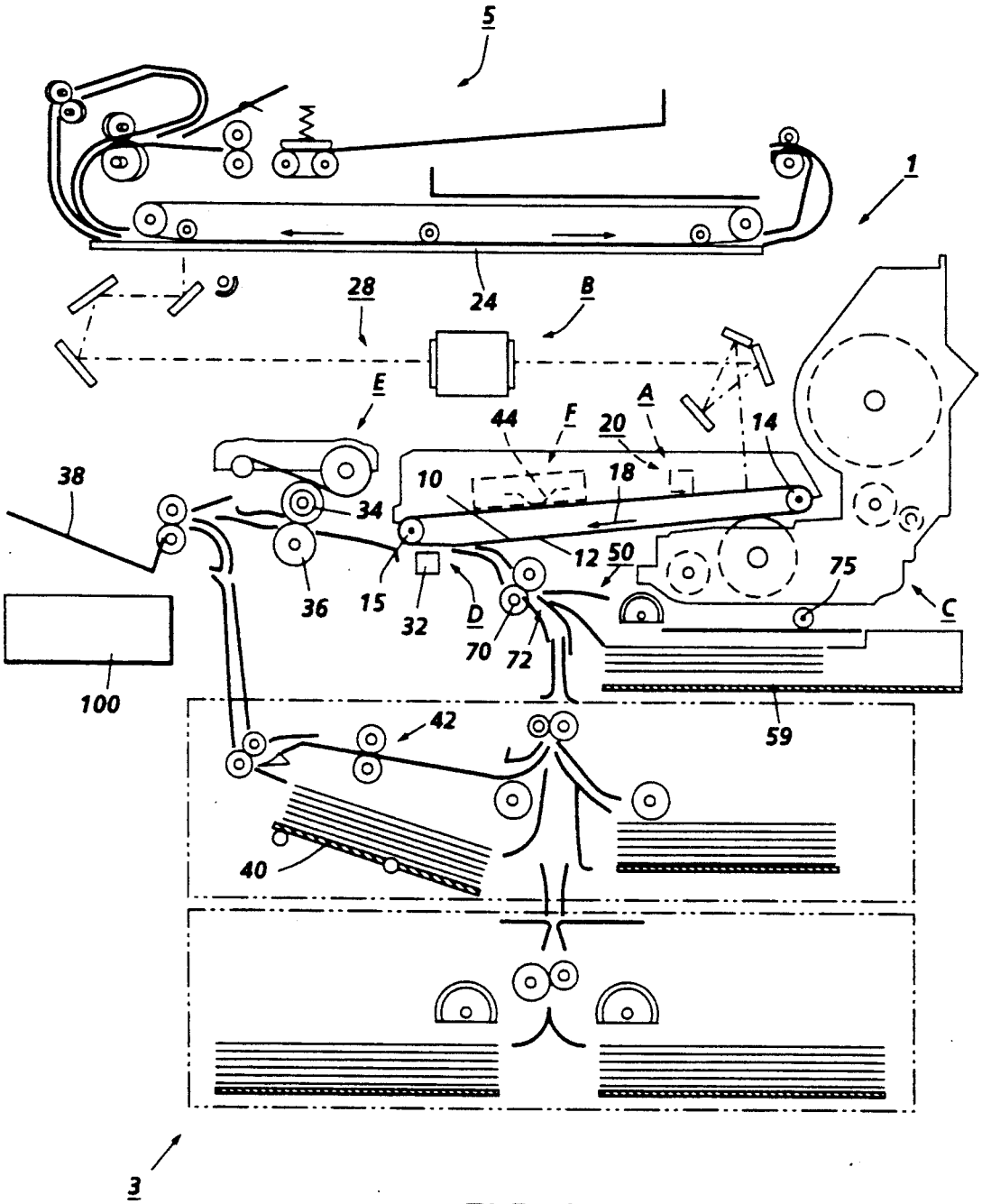
FIG. 3 is a schematic elevational view depicting an illustrative electrophotographic printing machine incorporating the sheet handler system of the present invention.

FIG. 3 schematically depicts an illustrative electrophotographic printing machine of the type in which the present invention may be employed. Specifically, the printing machine 1 of FIG. 3 has both a copy sheet handling system 3 and a document handling system 5 for transporting sheets of material such as paper, Mylar and the like, to and from processing stations of the machine 1. The machine 1, has conventional imaging processing stations associated therewith, including a charging station A, an imaging/exposing station B, a development station C, a transfer station D, a fusing station E, and a cleaning station F. It will be understood that a conventional finishing station (not shown) could easily be included in the machine. The machine 1 has a photoconductive belt 10 with a photoconductive layer 12 which is supported by a drive roller 14 and a tension roller 15. The drive roller 15 functions to drive the belt in the direction indicated by arrow 18. The drive roller 14 is itself driven by a motor (not shown) by suitable means, such as a belt drive.

The operation of the machine 1 can be briefly described as follows:

The photoconductive belt 10 is charged at the charging station A by a corona generating device 20. The charged portion of the belt is then transported by action the drive roller 14 to the imaging/exposing station B where a latent image is formed on the belt 10 corresponding to the image on a document positioned on a platen 24 via the light lens imaging system 28 of the imaging/exposing station B. It will also be understood that the light lens imaging system can easily be changed to an input/output scanning terminal or an output scanning terminal driven by a data input signal to likewise image the belt 10.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy handling system 3. In this case, a corona generating device 32 is provided to attract the toner image from the photoconductive belt 10 to the copy sheet substrate. The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to an output tray 38 or along a selectable duplex path including apparatus for buffered duplexing and for immediate duplexing (i.e., tray 40 and path 42 in the case of the illustrative printing machine of FIG. 3). The portion of the belt 10 which bore the developed image is then transported to the cleaning station F where residual toner and charge on the belt is removed in a conventional manner by a blade edge 44 and a discharge lamp (not shown). The cycle is then repeated.

The invention will now be discussed in greater detail with respect to FIG. 1, which represents a copy sheet transport 3 comprising a single sheet bypass feeder 45 for feeding sheets to a paper path 50 of an electrophotographic printing machine. The copy sheet transport 3 depicted herein includes a sheet input shelf 53 and 54 and a sensing switch 55 therein and a lateral registration edge 57 and 58.

In this case, the shelf 53 and registration edge 57 are integrally formed as a cover to a sheet cassette 59 for retaining additional sheets 60 for input to the path 50. The cassette 59 is of a type insertable and removable from the machine 1 and is provided with an aperture 62 so that a segmented feed roller 67 can feed individual sheets from the cassette 59. The cassette 59 is also preferably of the type with a bias floor panel or other known means for urging the top sheet of the stack 60 into a position for feeding by roller 67. The registration edge 58 and the shelf 54 are integral to the machine having an the outer wall or cover 69. Thus, insertion of the cassette into the machine forms the entire sheet feeding structure of the feeder 45. The path 50 includes registration rollers 70 for receiving sheets from the cassette 59 and the shelf 53, as well as sheets from a path 72.

Figure 1:
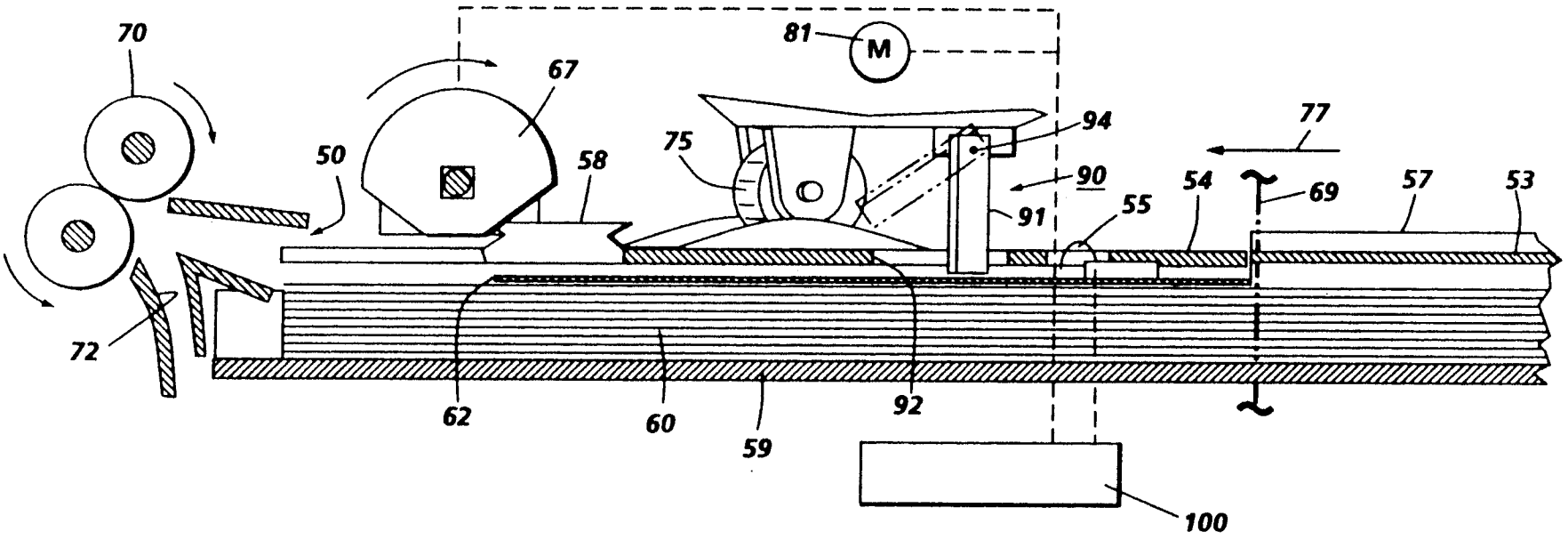
FIG. 1 is an enlarged elevational view of a sheet handler system incorporating the features of the present invention therein.
Figure 2:
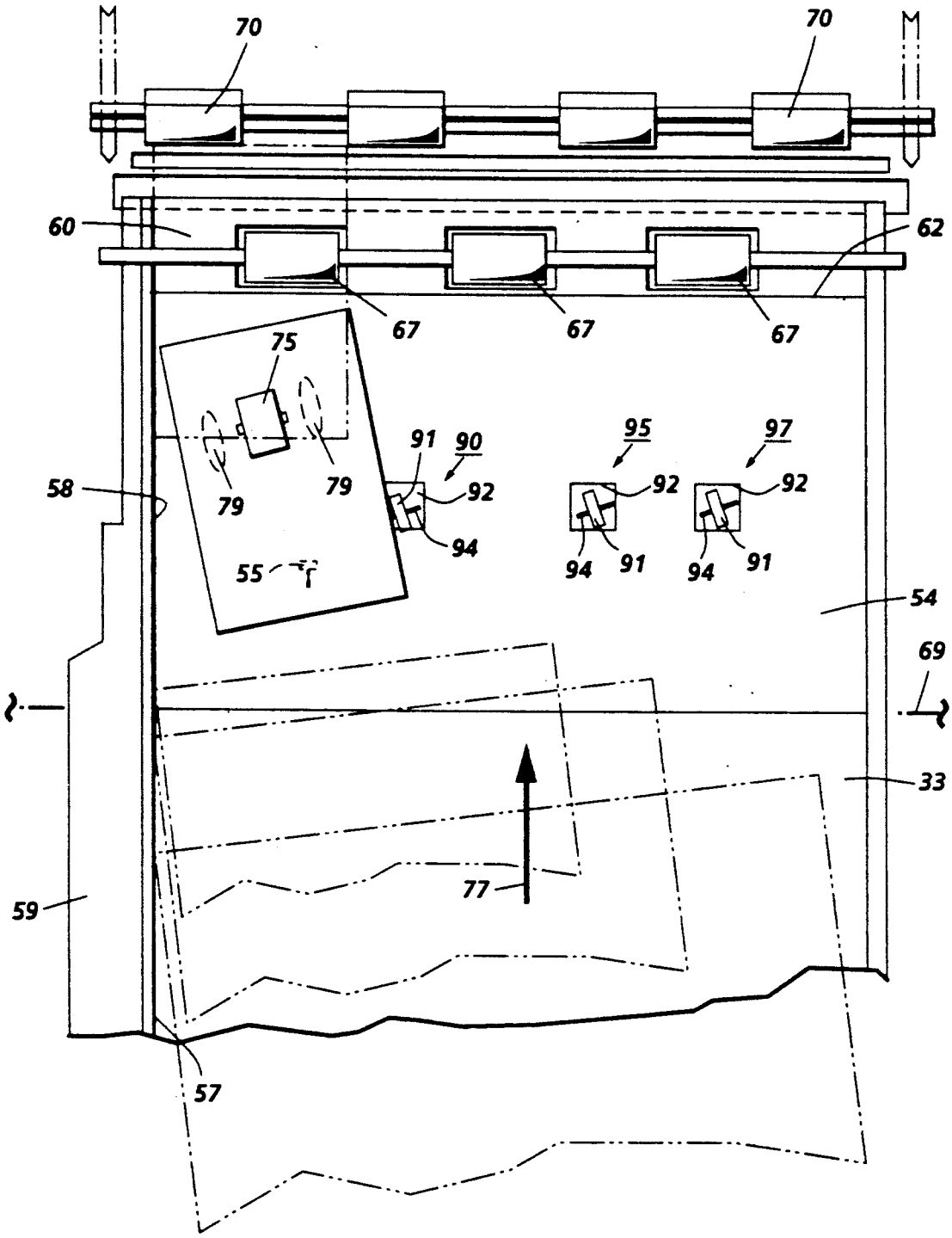
FIG. 2 is an plan view of the sheet handler system of FIG. 1.

Referencing now both FIGS. 1 and 2, a driven roller 75 is disposed in the sheet path at an angle to the process direction travel of sheets in the path 50 indicated by arrow 77. In this embodiment, two raised portions or bumps 79 are disposed on opposite sides of the roller 75. The bumps cooperate with the roller 75 so that sheets passing therebetween tend to be corrugated permitting improved transport of such sheets to the rollers 70. It will be understood that the roller urges sheets, due to its angular orientation, engaged thereby in both the process direction and into engagement with the registration edge 58, and, if the sheet is sufficiently long, a portion of the sheet will be urged into engagement with the registration edge 57. A drive means, such as motor 81 suitably connected to the roller 75 drives the roller. The micro switch 55 is also suitably connected to provide a sense signal when a sheet is present on the shelf 54 so that the drive means is actuated to drive the roller 75.

As should now be understood by those skilled in the art, a sheet is loaded by placing it on shelf 53 and sliding it along registration edge 57 toward shelf 54 and registration edge 58. When a sheet is pushed over the switch 55, the motor 81 and the roller 75 thereby are activated. A sheet passing between the nip formed by the bumps 79 and the roller 75 tend to be moved in the process direction 77 toward the rollers 70 and also toward the lateral registration edge 58. However, as previously indicated in some cases, the sheets, rather than registering along the edge adjacent the lateral registration edges 57 and 58, when inserted and pushed along the shelves 53 and 54, are laterally registered along the inserted leading edge of the sheet (i.e., the sheets are rotated or skewed approximately 90° when registered.)

To overcome this problem, a passive registration gate device 90 is provided which comprises a finger-shaped member 91 projecting through the path 50 into an aperture 92. The finger-shaped member 91 is mounted to the frame of the printing machine by a pin 94 so that the finger-shaped member 90 is rotatable in a vertical plane substantially perpendicular to the shelves 53 and 54. Preferably, however, the vertical plane is at a slight angle to the perpendicular process direction 77 which angle approximates the angle of the driven roller 75 to the process direction.

Additionally, it is preferred that gate devices 95 and 97, as seen in FIG. 2, with substantially identical finger-shaped members 91 as those of gate device 90, are positioned at various distances from the lateral registration edge 58. This arrangement allows transport sheets of various sizes. For example, in operation when registering a relatively narrow sheet (e.g., A-5 short-edge fed) the sheet, if it starts rotating in the path 50, the lateral edge of the sheet will engage the finger-shaped member 91 of gate 90 which is preferably disposed between 22 and 30 centimeters from the registration edge 58. In this event, the force exerted on the finger-shaped member 91 by the sheet would not be substantially along its axis of rotation. In this case, the finger-shaped member 91 would not rotate out of the path, and the gate device 90 would not open thereby preventing rotation of the sheet or otherwise inhibiting a sheet from skewing in the path. Thus, in the preferred embodiment, the gate device 90 promotes substantially linear transport of a sheet, as well as proper lateral registration of such transported sheets.

In the case of larger sheet (e.g., A-4 short edge feed), the sheet would again be directed along the shelves 53 and 54 proximate the registration edges 57 and 58 toward a path 50 to the operative position. The lead edge of the sheet would engage the finger-shaped member 91 of gate 90. The gate 90 due to the direction of travel of the sheet would open and permit passage of the sheet. Whereas, gate 92, which is preferably approximately 230 mm or 9 inches from lateral registration edge would prevent rotation of the sheet and promote registration thereof, if the sheet began to rotate. Likewise, gate 97 would be preferably positioned for other size sheets as will be appreciated by those skilled in the art.

As will be also understood, the control signals for the sheet handler operation are provided by controller 100 which is preferably a conventional microprocessor system, as exemplified, for example, in U.S. Pat. No. 4,475,156. It is contemplated that the controller controls all machine steps and functions described herein, as well as that of any and/or all apparatus and devices associated with the sheet handler, such as, for example, an electrophotographic printing machine.

It will be understood that in certain applications, such as those employing other types of sheet transport means, as well as to other applications, using other sizes and types of sheet materials, that the gate devices of the present invention may be varied in shape, position, number and size. In fact, while these gates, as described hereinabove, are merely biased in their operative position by gravity other biasing systems such as spring loading could be used. It will also be appreciated that the gates could be actuated into and out of the path by a solenoid. For example, a micro switch similar to switch 55 could be appropriately positioned and connected to determine prior to transport the appropriate gate device to be actuated and position such device in the path to control sheet skew.

It will also be understood that the present invention, although described in conjunction with a by-pass sheet feeder of the type often used to feed copy sheets, is adapted for use in various document handlers and copy sheet handlers (i.e., sheet handling devices) including, for example, automatic document and/or sheet handlers, as well as so-called semi-automatic document handlers.

Further, those skilled in the art will recognize the application of the present invention to sheet handlers and portions thereof which do not require precise registration of sheets but which require minimal skew or rotation of transported sheets. By way of example, a sheet handler of this type would include means for transport along a path, such as the arrangement of driven roller 75 and bumps 79 arranged to urge sheets in the process direction. In such a cases, two or more gates would be mounted on opposed sides of the transport means to inhibit skewing of sheets transported therebetween in either of the two rotational senses (clockwise and counterclockwise).

In recapitulation, a sheet handling system which includes a lateral edge registering device has been described. Specifically, the device includes an active lateral registration apparatus including a driven roller for urging sheets in a sheet path to a lateral registration edge. Apparatus for driving the sheet along the path have also been demonstrated. A passive gate device which permits generally linear sheet travel through the gate but opposes rotational or skew translation of a sheet is also included. The gate functions to permit sheets of larger sizes to pass the gate without substantial impediment. Whereas, a sheet passing between the gate and lateral registration edge is impeded from rotation in the path but permitted to laterally translate to the lateral registration edge.

It is, therefore, apparent that there has been provided in accordance with the present invention, an improved lateral edge registration device for use in sheet handlers including both copy sheet document handler systems that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method for registering sheets, comprising the steps of:

transporting a sheet along a path;

urging the sheet laterally toward an edge of the path to register a first side edge of the sheet;

engaging a second side edge of the sheet, opposed from the first side edge, to prevent rotation of the sheet, said step of engaging includes positioning a gate in the path to oppose rotation of the sheet; and opening the gate in response to engagement with an edge of the sheet substantially perpendicular to the first edge thereof to permit transport of the sheet therethrough.

2. A method for registering sheets, comprising the steps of:

transporting a sheet along a path, said step of transporting includes corrugating the sheet;

urging the sheet laterally toward an edge of the path to register a first side edge of the sheet;

engaging a second side edge of the sheet, opposed from the first side edge, to prevent rotation of the sheet, said step of engaging includes mounting a passive sheet guide for opposing sheet rotation in the path while permitting substantially free transport along the path and in a direction substantially perpendicular to the path toward a registration member.

3. In an apparatus for registering sheets, while transporting a sheet along a sheet path, with a registration system for urging the sheet laterally toward a registration edge of the sheet path to register a first side edge of the sheet, the improvement comprising a sheet guide for engaging a second and opposite side edge of the sheet in the sheet path to prevent rotation of the sheet being so registered, said sheet guide comprising a gate member positionable in the sheet path to oppose rotation of the sheet, said gate member opening in response to engagement with an edge of the sheet which is substantially perpendicular to the first edge of the sheet to permit transport of the sheet through the sheet path without obstruction by said gate member.

4. The apparatus of claim 3, wherein said gate member comprises a finger-shaped projection which operatively projects into the sheet path.

5. The apparatus of claim 4, wherein said finger-shaped projection is mounted for movement into and out of the sheet path.

6. The apparatus of claim 5, wherein said finger-shaped projection is moved into and out of the sheet path by said engagement with an edge of the sheet which is substantially perpendicular to the first edge of the sheet.

* * * * *